US007301518B2

(12) United States Patent
Hosaka

(10) Patent No.: US 7,301,518 B2
(45) Date of Patent: Nov. 27, 2007

(54) DRIVING METHOD FOR ELECTRO-OPTICAL APPARATUS, ELECTRO-OPTICAL APPARATUS AND ELECTRONIC EQUIPMENT

(75) Inventor: Hiroyuki Hosaka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 716 days.

(21) Appl. No.: 10/823,657

(22) Filed: Apr. 14, 2004

(65) Prior Publication Data

US 2004/0246216 A1 Dec. 9, 2004

(30) Foreign Application Priority Data

Apr. 16, 2003 (JP) ..... 2003-111527

(51) Int. Cl.
*G09G 3/36* (2006.01)

(52) U.S. Cl. ..... 345/94; 345/87; 345/96

(58) Field of Classification Search ..... 345/55–100
See application file for complete search history.

(56) References Cited

U.S. PATENT DOCUMENTS

| | | | | |
|---|---|---|---|---|
| 5,867,234 | A | 2/1999 | Takano et al. | |
| 6,064,404 | A | 5/2000 | Aras et al. | |
| 6,342,881 | B1 | 1/2002 | Inoue | |
| 6,396,469 | B1 | 5/2002 | Miwa et al. | |
| 6,784,863 | B2 * | 8/2004 | Yanagi et al. | 345/96 |
| 6,819,311 | B2 * | 11/2004 | Nose et al. | 345/100 |
| 6,873,311 | B2 | 3/2005 | Yoshihara et al. | |
| 6,873,313 | B2 | 3/2005 | Washio et al. | |
| 6,965,367 | B2 | 11/2005 | Tanaka et al. | |
| 2002/0084969 | A1 * | 7/2002 | Ozawa | 345/96 |
| 2004/0196415 | A1 | 10/2004 | Kimura et al. | |

FOREIGN PATENT DOCUMENTS

| | | |
|---|---|---|
| CN | A-1149932 | 5/1997 |
| CN | A-1236464 | 11/1999 |
| EP | 1 594 022 A1 | 11/2005 |
| JP | A 8-334741 | 12/1996 |
| JP | A-10-198321 | 7/1998 |
| JP | A-11-109921 | 4/1999 |
| JP | A-11-119189 | 4/1999 |

(Continued)

*Primary Examiner*—David L. Lewis
(74) *Attorney, Agent, or Firm*—Oliff & Berridge, PLC

(57) ABSTRACT

The invention provides a driving method for an electro-optical apparatus, the electro-optical apparatus, and electronic equipment in which unevenness of luminance in the vertical direction can be controlled. A data signal is written to pixels in a first sub field SF1 and a non-data signal, having the same polarity as the data signal, and of the maximum voltage is written to the pixels in a second sub field SF2 in each frame. When proceeding from SF1 to SF2, variations in potential applied to each signal line can be decreased, and the amount of leakage of each pixel electrode potential is reduced. After having obtained a black display (in the case of a normally white mode) by writing the non-data signal, a data signal having the opposite polarity from the data signal in the previous frame is written to the pixels. Since a black display is in the stable area of a V-T curve of the liquid crystal, and variations in transmittance ratio can be small even when the voltage is varied to some extent, variations in transmittance rate of the liquid crystal at the each pixel, that is, unevenness of luminance when proceeding from the SF2 to the subsequent frame SF1 is small.

6 Claims, 10 Drawing Sheets

FOREIGN PATENT DOCUMENTS

| | | |
|---|---|---|
| JP | A 2000-10076 | 1/2000 |
| JP | 2001-042282 | 2/2001 |
| JP | A-2001-343922 | 12/2001 |
| JP | A-2002-175057 | 6/2002 |
| JP | 2002-215111 | 7/2002 |
| JP | 2002-341310 | 11/2002 |
| JP | A-2002-366124 | 12/2002 |
| JP | A-2003-036056 | 2/2003 |
| KR | 2000-0064278 | 11/2000 |
| KR | 2001-0093034 | 10/2001 |
| WO | WO 02/097523 A1 | 12/2002 |

* cited by examiner

IMPULSE TYPE DISPLAY (1 FRAME INVERSION)

DRIVING METHOD FOR ELECTRO-OPTICAL APPARATUS, ELECTRO-OPTICAL APPARATUS AND ELECTRONIC EQUIPMENT

BACKGROUND OF THE INVENTION

1. Technical Field of Invention

The present invention relates to a driving method for an electro-optical apparatus, an electro-optical apparatus, and electronic equipment.

2. Description of Related Art

As an electro-optical apparatus in the related art, an active matrix liquid crystal display device provided with thin film transistors for each of a plurality of pixels disposed in a matrix, wherein an electric potential of a common line opposing a pixel electrode of each pixel via a liquid crystal is inverted on a field-to-field basis, is known. See, for example, FIG. 4 in Japanese Unexamined Patent Application Publication No. 8-334741. In this liquid crystal display device, a video signal of positive polarity and a video signal of negative polarity are written to each pixel alternately on a field-to-field basis and the liquid crystal is driven in an alternating current system by inverting the potential of the common line on a field-to-field basis. Accordingly, such advantage that the amplitude of a data signal like the video signal can be reduced and hence electric consumption may be reduced is realized.

As another related art, a liquid crystal display device in which a chiral smectic liquid crystal is used to enable high-speed response and gray scale control, so that the quality of a motion picture is improved is known. See, for example, Japanese Unexamined Patent Application Publication No. 2000-10076. In this liquid crystal display device, a chiral smectic liquid crystal is used as a ferroelectric liquid crystal having a memory property (bistability), and the memory property is extinguished (monostabilized) for realizing the gray scale display. More specifically, when a voltage of positive polarity ($E>0$) is applied, a liquid crystal element is tilted (switched) in the direction corresponding to the polarity of the voltage with respect to the position when no voltage is applied ($E=0$). The tilting angle corresponds to the magnitude of the applied voltage. On the other hand, when a voltage of negative polarity ($E<0$) is applied, the liquid crystal element stays at the same position as it is when no voltage is applied.

In this manner, in the liquid crystal display device in which the chiral smectic liquid crystal having the memory property extinguished is employed, as shown in FIG. 14 and FIG. 15 in Japanese Unexamined Patent Application Publication No. 2000-10076, one frame is divided into two fields, a voltage of positive polarity Vx is applied to the liquid crystal in a first field 1F, and a negative voltage −Vx is applied to the liquid crystal in a second field 2F. Accordingly, in the first field 1F, the gray scale display state (the amount of transmitted light) according to the voltage Vx is obtained at each pixel and, in the second field 2F, the amount of transmitted light at substantially zero level is obtained at each pixel. In other words, in Japanese Unexamined Patent Application Publication No. 2000-10076, there is proposed a liquid crystal display device of a frame inversion driving system utilizing the operating characteristic of monostabilized liquid crystal material in which transmission of light is controlled by the voltage of one of the polarities in an analogue manner and transmission of light is prohibited by the voltage of the other polarity.

SUMMARY OF THE INVENTION

In the related art in which frame inversion driving is performed, as in Japanese Unexamined Patent Application Publication No. 8-334741 described above, there is a risk in which unevenness of luminance occurs in the vertical direction on the liquid crystal display panel. The reason will be described based on the liquid crystal display panel 100 shown in FIG. 15, which is driven by frame inversion driving system. In this liquid crystal display panel 100, a plurality of scanning lines Y1-Ym are selected, for example, from the top in sequence, and a data signal of positive polarity is written to each pixel in sequence to constitute one frame (hereinafter, this frame is referred to as positive field). Likewise, in the subsequent frame (hereinafter, this frame is referred to as negative field), the plurality of scanning lines Y1-Y-m are selected, and a data signal of negative polarity is written to each pixel in sequence.

Since such operation is repeated for each frame, a period of time from the moment when the data signal is written to the moment when the operation is proceeded to the subsequent frame is shorter for each of pixels which are connected respectively to the scanning lines selected later in one frame out of the scanning lines Y1-Ym than for each of pixels which are connected respectively to the scanning lines selected earlier in the frame out of the same. In other words, pixels connected respectively to the scanning lines selected later are affected for a longer time by inversion of potential applied to the signal line in the subsequent frame. Accordingly, the pixel electrode potentials of pixels according to the data signals written and maintained in pixels which are connected respectively to the scanning lines Y1-Ym leak through an off resistance of a switching element. The amount of leakage (potential lowered at each pixel electrode) is larger in the lower pixels on the liquid crystal display panel 100. As a consequence, the luminance of the liquid crystal display panel 100 in the vertical direction is higher in the pixels located at lower positions since the extent of lowering of the voltage value in the pixel electrode is larger in the lower position, therefore, brighter display is obtained (in the case of the normally white mode).

In the related art of Japanese Unexamined Patent Application Publication No. 2000-10076 described above, as in the case of the Japanese Unexamined Patent Application Publication No. 8-334741 described above, there is a risk in which unevenness of luminance occurs in the vertical direction on the liquid crystal display panel. This is because a voltage of an opposite polarity (negative voltage −Vx) from the first field 1F is applied to the liquid crystal in the second field 2F so that the amount of transmitted light at zero-level can be obtained at each pixel in the second field 2F described above, and thus variations in voltage at each pixel electrode during a retained period from the moment when a data signal (voltage of positive polarity Vx) is written to each pixel in the first field 1F to the moment when the negative voltage −Vx is applied in the second field 2F significantly differ on the liquid crystal display panel in the vertical direction.

Accordingly, it is an object of the invention to provide a driving method for an electro-optical apparatus, an electro-optical apparatus, and electronic equipment in which unevenness in luminance in the vertical direction can be controlled.

In a driving method for an electro-optical apparatus including an electro-optical element provided between two substrates and switching elements provided, respectively, at a plurality of pixels disposed in a matrix manner corresponding to the intersections of a plurality of scanning lines and a plurality of signal lines, and being adapted to write a data signal of positive polarity and a data signal of negative polarity to the pixels via the switching elements alternately on a frame-to-frame basis, the electro-optical apparatus in the present invention is summarized in that after having written any one of the data signal of positive polarity and the data signal of negative polarity in each frame, a non-data signal having the same polarity as the written data signal and of the maximum voltage value is written to the pixels and, after having written the non-data signal, a data signal having opposite polarity from the data signal which is written in the previous frame is written to the pixels.

In this arrangement, after having written the data signal of any one of positive polarity and negative polarity in each frame, the non-data signal having the same polarity as the written data signal and of a maximum voltage value is written to the pixels. Accordingly, when the non-data signal is written to the pixels after having written the data signal in each frame, variations in potential applied to each signal line corresponds to the difference between the data signal and the non-data signal having the same polarity, which is smaller in comparison with the case of normal frame inversion driving. Therefore, a pixel electrode potential of the each pixel to which the data signal is written varies due to leakage by being affected by variations in potential applied to the each signal line via the off resistance of the switching element. However, the amount of leakage is smaller than the case of the aforementioned normal frame inversion driving. The term normal frame inversion driving refers to the driving method performed in the liquid crystal display device in the related art described in conjunction with Japanese Unexamined Patent Application Publication No. 8-334741 and Japanese Unexamined Patent Application Publication No. 2000-10076, described above.

After having written the data signal in each frame, the non-data signal having the same polarity as the written data signal and of the maximum voltage value is written to the pixels. Accordingly, in the case where the electro-optical element is liquid crystal and the display mode is normally white mode, a black display is obtained, and in the case where the display mode is normally black mode, a white display is obtained. In this manner, after having obtained a while display or a black display in the pixels in each frame, (in the subsequent frame), the data signal having the opposite polarity from the data signal written in the previous frame is written to the pixels. In this manner, even when the data signal having the opposite polarity from the data signal written in the previous frame is written to the pixels after having obtained a white display or a black display, the pixel electrode potential of the each pixel in which the voltage of a white display or a black display is maintained is affected by variations in potential applied to the each signal line and varies due to the aforementioned leakage. However, a white display or a black display is in the stable area of a V-T curve, and thus the amount of variation in transmittance ratio is small even when the voltage varies to some extent. Therefore, even when the pixel electrode potential at each pixel varies by being affected by variations in potential applied to the each signal line when the data signal having the opposite polarity from the data signal written in the previous frame is written to the pixels after having obtained a white display and a black display, variations in transmittance ratio of the liquid crystal at the each pixel, that is, unevenness in luminance is small.

Since the aforementioned frame inversion driving is performed, cross-talk, that is, unevenness in luminance in the vertical direction caused by variations in the pixel electrode potential of the each pixel by being affected by variations in potential applied to the each signal line can be controlled. When the non-data signal is written to obtain a black display at the pixels, the period of black display is generated between one frame and the subsequent frame in which the data signals are written respectively. Accordingly, a display of an impulse type (display of non-hold type) is obtained, and hence the advantages in that the quality of the motion picture is improved may be obtained at the same time.

In the driving method for an electro-optical apparatus, the electro-optical element can be liquid crystal, and a three-terminal switching element which is turned on when a scanning signal is supplied during each selection period for selecting the plurality of scanning lines in sequence is employed as the switching element, and the data signal and the non-data signal supplied from the plurality of signal lines are written to the pixels in line sequence via the three-terminal switching element in the ON-state.

In this arrangement, in a three-terminal type active matrix liquid crystal display device using the three-terminal switching element such as a thin film transistor (TFT) as the switching element for each pixel, control of unevenness in luminance in the vertical direction and improvement of the quality of the motion picture are achieved.

In a driving method for an electro-optical apparatus including an electro-optical element provided between two substrates, and switching elements provided respectively at a plurality of pixels disposed in a matrix manner corresponding to the intersections between a plurality of scanning lines and a plurality of signal lines, and being adapted to write a data signal of positive polarity and a data signal of negative polarity to each pixel via the switching elements alternately on a frame-to-frame basis in a pulse duration modulation system, the driving method for an electro-optical apparatus in the invention can be summarized in that after having written any one of the data signal of positive polarity and the data signal of negative polarity in each frame, a non-data signal having the same polarity as the written data signal and of a maximum pulse duration value is written to the pixels and, after having written the non-data signal, a data signal having opposite polarity from the data signal which is written in the previous frame is written to the pixels.

In this arrangement, after having written the data signal of any one of positive polarity and negative polarity in each frame, the non-data signal having the same polarity as the written data signal and of a maximum pulse duration is written to the pixels. In this manner, the non-data signal to be written to the pixels after having written the data signal is a voltage signal having the same polarity as the data signal written in the previous frame and of the maximum pulse duration. Therefore, when the non-data signal is written to the pixels after having written the data signal in each frame, there is no variation in potential applied to each signal line. Therefore, the pixel electrode potential of each pixel to which the data signal is written does not vary according to leakage due to off resistance of the switching element.

After having written the non-data signal, a data signal having the opposite polarity from the data signal written in the previous frame is written to the pixels. By writing the non-data signal, in the case where the electro-optical element is liquid crystal, and the display mode is the normally white mode, a black display is obtained, and in the case where the display mode is normally black mode, a white display is obtained. In this manner, when the data signal having the opposite polarity from the data signal in the previous frame to the pixels after having obtained a white display or a black display at the pixels in each frame, the pixel electrode potential of the each pixel, in which the voltage of a white display and a black display is retained, is affected by variations in potential applied to the each signal line and varies by the leakage. However, a white display or a black display is in the stable area of a V-T curve, and thus the amount of variation in transmittance ratio is small even when the voltage varies to some extent. Therefore, even when the pixel electrode potential at each pixel varies by being affected by variations in potential applied to the each signal line when the data signal having the opposite polarity from the data signal written in the previous frame is written to the pixels after having obtained a white display and a black display, variations in transmittance ratio of the liquid crystal at the each pixel, that is, unevenness in luminance is small.

Since the aforementioned frame inversion driving is performed, cross-talk, that is, unevenness in luminance in the vertical direction caused by variations in the pixel electrode potential of the each pixel by being affected by variations in potential applied to the each signal line can be controlled. When the non-data signal is written to obtain a black display of the pixels, the period of black display is generated between one frame and the subsequent frame in which the data signals are written respectively. Accordingly, a display of an impulse type (display of non-hold type) is obtained, and hence the advantages in that the quality of the motion picture is improved may be obtained at the same time.

In the driving method for an electro-optical system, the electro-optical element can be a liquid crystal, a two-terminal switching element which turns on when a differential voltage between positive or negative scanning voltage supplied via the scanning line alternately on a frame-to-frame basis during each selection period for selecting the plurality of scanning lines in sequence and the signal voltage supplied via the signal line during the each selection period exceeds a threshold is used as the switching element, and the data signal or the non-data signal, which is the differential voltage, is written to the pixels during the each selection period in line sequence.

In this arrangement, in a two-terminal type active matrix liquid crystal display device using the two-terminal switching element, such as a non-linear resistant element including an MIM element as the switching element of the each pixel, control of unevenness in luminance in the vertical direction and improvement of the quality of the motion picture are achieved.

In the driving method for an electro-optical apparatus, the each frame can be divided into a first sub field and a second sub field, and a data signal having the opposite polarity from the previous frame is written during the first sub frame of the each frame, and the non-data signal is written during the second sub field of the each frame. In this arrangement, a data signal of positive polarity or of negative polarity is written in the first sub field of the specific frame to obtain the display of one screen page, and non-data signal is written in the second sub field of the same frame to obtain a white display or a black display. Accordingly, a display with less flickering is obtained.

In the driving method for an electro-optical apparatus, the period of time for writing and retaining the non-data signal in the second sub field is shorter than the period of time for writing and retaining the data signal in the first sub field. In this arrangement, the sufficient period of time can be secured for writing and retaining the data signal, and hence brighter display is achieved.

In the driving method for an electro-optical apparatus, one frame for writing the non-data signal can be provided between two frames in which the data signals of the opposite polarity are written respectively. In this arrangement, since one frame for writing the non-data signal is provided between two frames in which the data signals having the opposite polarities are written respectively, control of timing to write the data signal and the non-data signal is facilitated, and the sufficient period of time can be secured for writing the data signal.

In the driving method for an electro-optical apparatus, the period of time for writing the data signal in the one frame provided between the two frames is shorter than the period of time for writing the data signals respectively in the two frames. In this arrangement, the sufficient period of time can be secured for writing and retaining the data signal, and hence the brighter display is achieved.

The electro-optical apparatus according to the present invention including an electro-optical element provided between two substrates and switching elements provided, respectively, at a plurality of pixels disposed in a matrix manner corresponding to the intersections of a plurality of scanning lines and a plurality of signal lines, and being adapted to write a data signal of positive polarity and a data signal of negative polarity to each pixel via the switching elements alternately on a frame-to-frame basis is summarized in that a three-terminal switching element as the switching element, which is turned on when a scanning signal is supplied during each selection period for selecting the plurality of scanning lines in sequence, a scanning line driving circuit and a signal line driving circuit for driving the plurality of scanning line and the plurality of signal line, respectively, and a control circuit for controlling the scanning line driving circuit and the signal line driving circuit in such a manner that after having written any one of the data signal of positive polarity and the data signal of negative polarity in each frame, a non-data signal having the same polarity as the written data signal and of maximum voltage value is written to the pixels, and after having written the non-data signal, a data signal having the opposite polarity from the data signal written in the previous frame is written to the pixels are provided.

In this arrangement, in the three-terminal type active matrix liquid crystal display device employing the three-terminal switching element such as the thin film transistor as the switching element for the each pixel, control of unevenness of luminance in the vertical direction and improvement of the quality of the motion picture are achieved.

The electro-optical apparatus according to the invention can include an electro-optical element provided between two substrates, switching elements provided respectively at a plurality of pixels disposed in a matrix manner corresponding to the intersections of a plurality of scanning lines and a plurality of signal lines, and being adapted to write a data signal of positive polarity and a data signal of negative polarity to each pixel via the switching elements alternately on a frame-to-frame basis is summarized in that a two-terminal switching element as the switching element which is turned on when a data signal having a pulse duration according to the gray scale at a differential voltage between positive or negative scanning voltage supplied via the scanning line alternately on a frame-to-frame basis during each selection period for selecting the plurality of scanning lines in sequence and a signal voltage supplied via the signal line during the each selection period exceeds a threshold, a scanning line driving circuit and a signal line driving circuit for driving the plurality of scanning lines and the signal lines, respectively, are provided, and in that after having written any one of the data signal of positive polarity and the data signal of negative polarity during the selection period of the each frame, the non-data signal having the same polarity as the written data signal and of the maximum pulse duration is written to the pixels, and the after having written the non-data signal, the data signal having the opposite polarity from the data signal written in the previous frame is written to the pixels.

In this arrangement, in a two-terminal type active matrix liquid crystal display device using the two-terminal switching element, such as a non-linear resistant element including an MIM element as the switching element of the each pixel, control of unevenness in luminance in the vertical direction is achieved. In addition, when the non-data signal can be written to obtain a black display of the pixels, the advantage that the quality of the motion picture is improved is achieved at the same time.

In this electro-optical apparatus, the each frame can be divided into a first sub field and a second sub field, and a data signal having the opposite polarity from the previous frame is written during the first sub field of the each frame, and the non-data signal is written during the second sub field of the each frame. In this arrangement, a data signal of positive polarity or of negative polarity is written in the first sub field of the specific frame to obtain the display of one screen page, and non-data signal is written in the second sub field of the same frame to obtain a white display or a black display. Accordingly, a display with less flickering is obtained.

In this electro-optical apparatus, the period of time for writing and retaining the non-data signal in the second sub field is shorter than the period of time for writing and retaining the data signal in the first sub field. In this arrangement, the sufficient period of time can be secured for writing and retaining the data signal, and hence brighter display is achieved.

The invention can also include electronic equipment having the electro-optical apparatus described above. In this arrangement, the quality of display of electronic equipment may be improved. Therefore, electronic equipment of preferable visibility is achieved.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
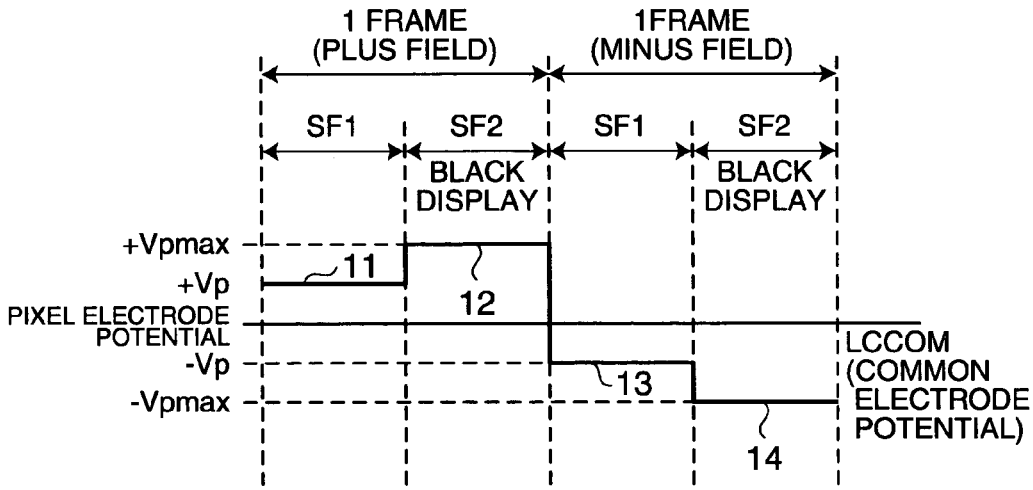
FIG. 1 is a wave form chart showing a driving method for a liquid crystal display device according to a first embodiment.

Referring now to the drawings, embodiments in which the present invention is applied to a liquid crystal display device will be described.

Referring to FIG. 1 to FIG. 7, a liquid crystal display device according to a first embodiment will be described.

Figure 2:
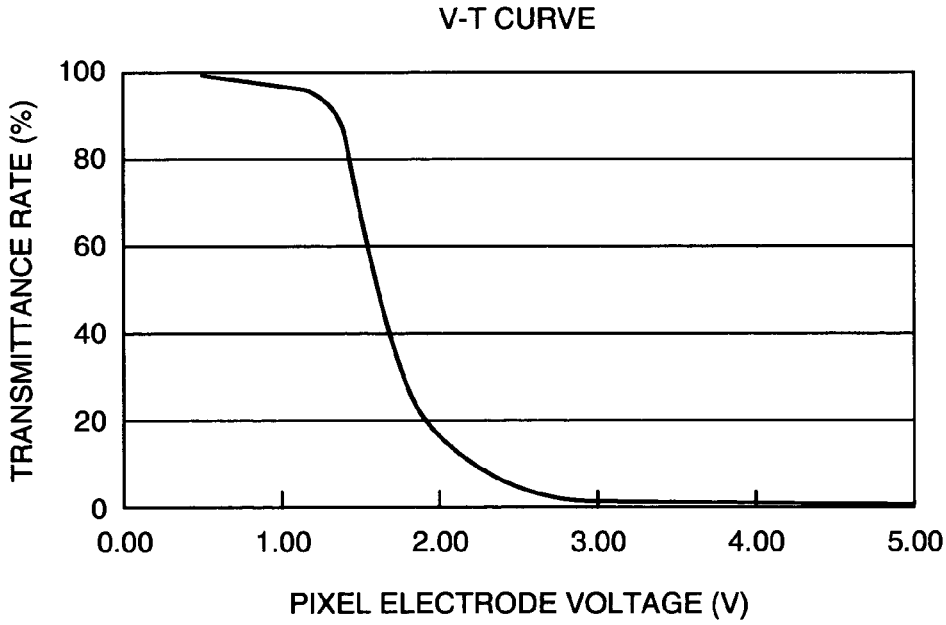
FIG. 2 is a graph showing the V-T characteristic (Voltage-Transmittance ratio characteristic) of the liquid crystal.
Figure 3:
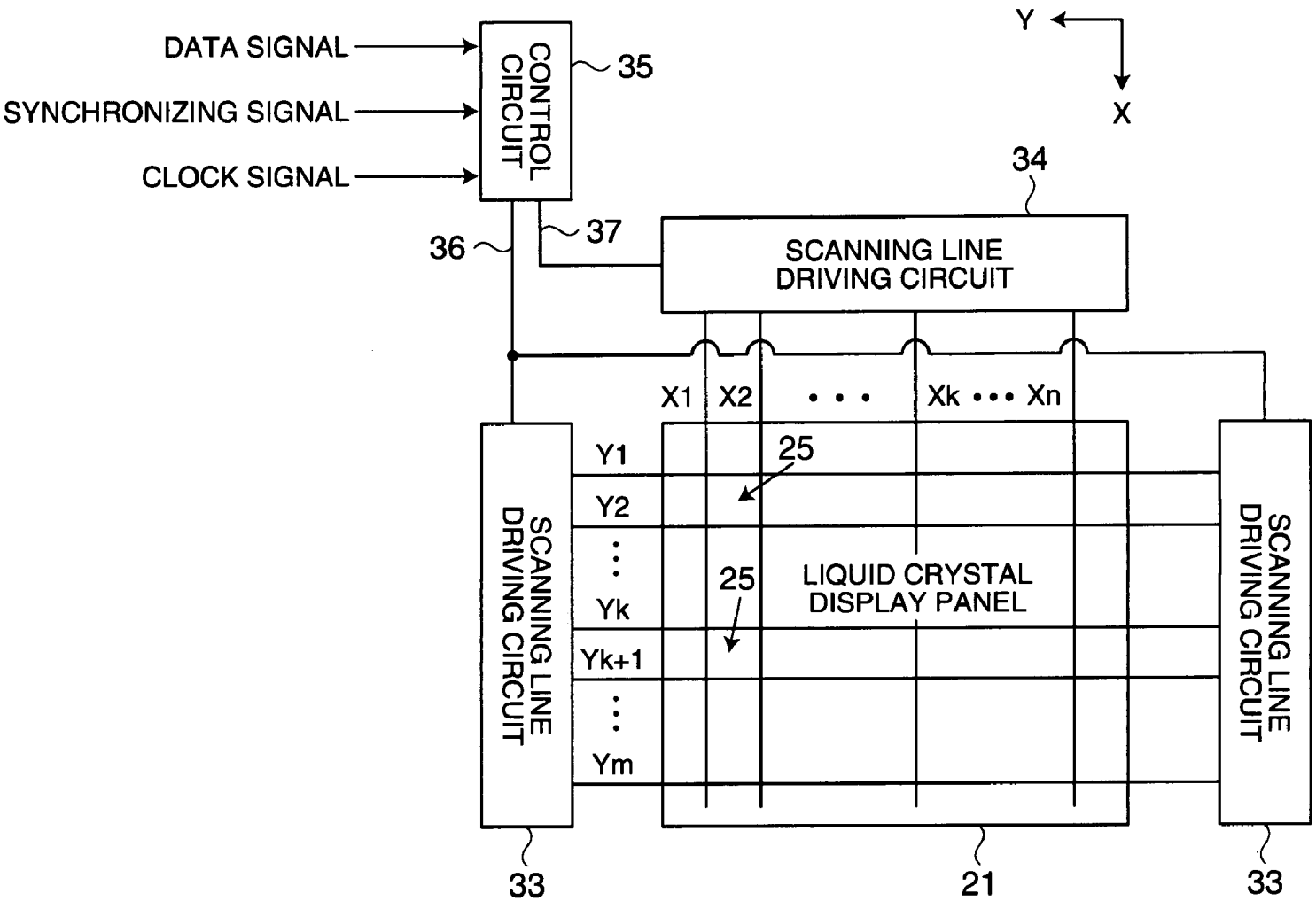
FIG. 3 is a schematic block diagram showing the electrical structure of a driving circuit of the liquid crystal display device.
Figure 4:
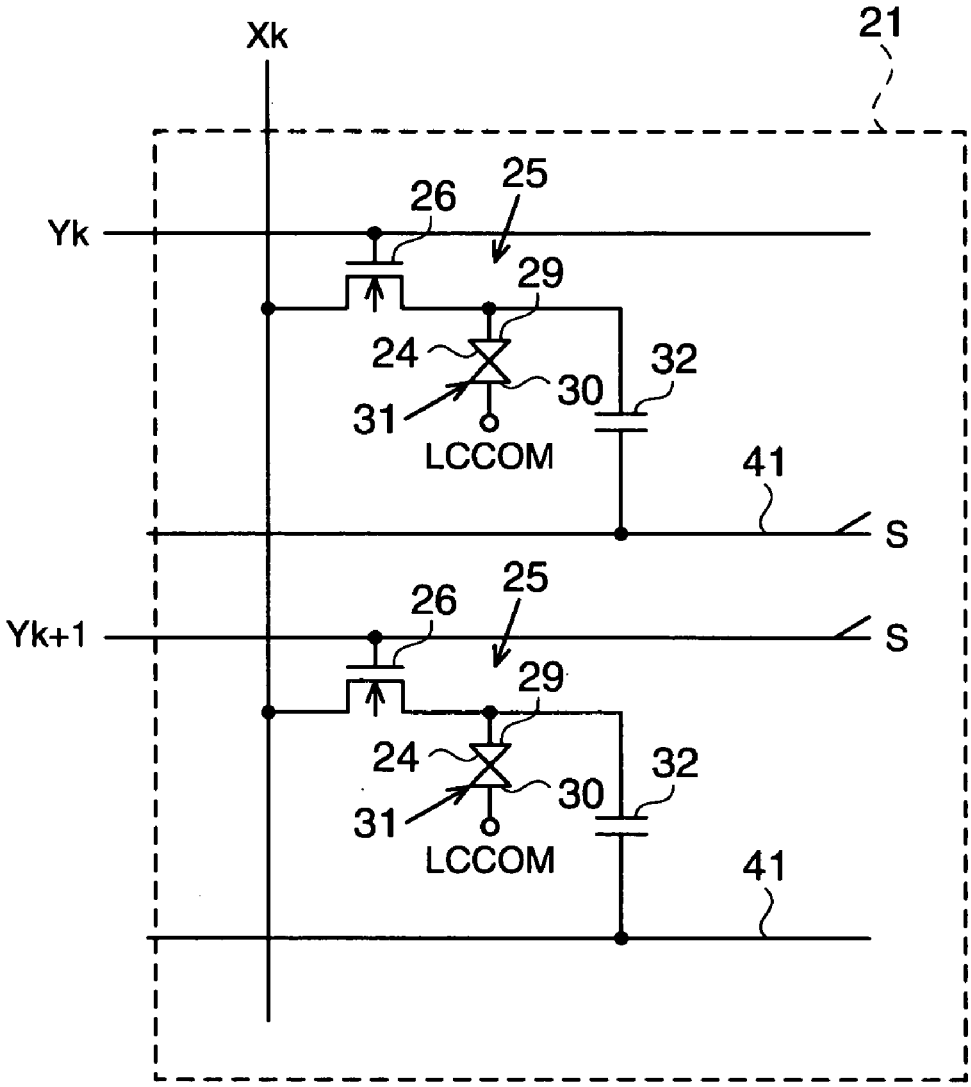
FIG. 4 is a circuit diagram showing part of an electrically equivalent circuit of a liquid crystal display panel.

FIG. 1 shows a driving method for the liquid crystal display device according to the first embodiment, and FIG. 2 shows a V-T characteristic (Voltage-Transmittance ratio characteristic) of the liquid crystal used in the liquid crystal display device. FIG. 3 schematically shows an electrical structure of a driving circuit of the liquid crystal display device, and FIG. 4 shows part of an electrical equivalent circuit of a liquid crystal display panel.

The liquid crystal display device according to the first embodiment is a three-terminal type active matrix liquid crystal display device employing a three-terminal switching element, such as a thin film transistor (TFT), and its display mode is a normally white mode. This liquid crystal display device performs frame inversion driving for writing a data signal of positive polarity and a data signal of negative polarity to each pixel via switching elements of a plurality of pixels disposed in a matrix manner alternately on a frame-to-frame basis.

In a driving method for (frame inversion driving) the liquid crystal display device according to the invention, after having written the data signal in each frame, a non-data signal having the same polarity as the written data signal and of a maximum voltage value is written to the pixels in line sequence. It is characterized in that after having written the non-data signal, a data signal having the opposite polarity from the data signal in the previous frame is written to the pixels in line sequence.

In the liquid crystal display device according to the present embodiment, as shown in FIG. 1, one frame is divided into two sub fields SF1, SF2, and a data signal having the opposite polarity from the previous frame is written in line sequence in the first sub field SF1 in each frame, and the non-data signal is written in line sequence in the second sub field SF2 of each frame.

In other words, in a plus field in which the data signal of positive polarity is written, a data signal 11 of positive polarity (+Vp) is written in the first sub field SF1, and a non-data signal 12 having the same polarity as the data signal 11 (positive polarity) and of a maximum voltage value (+Vmax) is written to every pixel in the second sub field SF2. In the period of the second sub field SF2 in which the non-data signal 12 is written to every pixel, a black display is obtained since the display mode of the liquid crystal display panel 21 is in a normally white mode in which the display becomes darker as the absolute value of a voltage applied to each pixel electrode 29 (pixel voltage) increases.

After having obtained a black display, in a minus field, which corresponds to the subsequent frame, a data signal 13 of negative polarity (−Vp) is written in the first sub field SF1, and a non-data signal 14 having the same polarity as the data signal 13 and of the maximum voltage value (−Vmax) is written to every pixel in the second sub field SF2. In this manner, in the period of the second sub field SF2 in which the non-data signal 14 is written to every pixel, a black display is obtained. This procedure is repeated.

In the liquid crystal display device in the present embodiment, the liquid crystal display panel 21 shown in FIG. 3 is provided. The liquid crystal display panel 21 can include an element substrate and an opposed substrate, not shown, and enclosed between these two substrates is a liquid crystal 24 (see FIG. 4) of TN (Twisted Nematic) type. The liquid crystal display panel 21 includes, as shown in FIG. 3 and FIG. 4, m n pixels 25 disposed in a matrix manner corresponding to intersections between scanning lines Y1-Ym arranged in m-rows and signal lines X1-Xn arranged in n-columns, and thin film transistors (hereinafter referred to as "TFT") 26 as the switching element provided at each pixel 25.

As shown in FIG. 3 and FIG. 4, a gate of the TFT 26 of each of the pixels 25 is connected to one of the scanning lines Y1-Ym, a source thereof is connected to one of the signal lines X1-Xn, and a drain thereof is connected to the pixel electrode 29 of one pixel 25 corresponding thereto. The pixel electrode 29 of the each pixel 25 opposes a single common electrode 30 provided on the side of the opposed substrate via the liquid crystal 24, as shown in FIG. 4. The aforementioned frame inversion driving is performed by inversing the potential of the common electrode 30 (common electrode potential LCCOM) on a frame-to-frame basis. The each pixel 25 includes a liquid crystal capacitor 31 made up of the liquid crystal 24 between the rectangular pixel electrode 29 and the common electrode 30, and an accumulating capacitor 32 connected in parallel to the liquid crystal capacitor 31 and being a capacitive element for reducing leakage of the liquid crystal capacitor. A minus terminal of the each accumulating capacitor 32 is connected to a capacitor wiring 41.

Subsequently, referring to FIG. 3 and FIG. 4, the electric structure of a driving circuit for driving the liquid crystal display panel 21 of the liquid crystal display device will be described. The driving circuit can include two scanning line driving circuits 33, 33 on the left and the right sides for driving the scanning lines Y1-Ym, a signal line driving circuit 34 for driving the signal lines X1-Xn, and a control circuit 35 for controlling the scanning line driving circuits 33 and the signal line driving circuit 34. The control circuit 35 is adapted to be supplied with data signals, synchronizing signals, and clock signals from an external circuit. From the control circuit 35 to the two left and right scanning line control circuits 33, 33, vertical synchronizing signals, clock signals, and the like are supplied via a signal line 36. From the control circuit 35 to the signal line driving circuit 34, data signals, horizontal synchronizing signals, and the like are supplied via a signal line 37. The element substrate is formed with an input terminal to which various signals are supplied form the external circuit, and so on, though they are not shown in the drawings.

Figure 5:
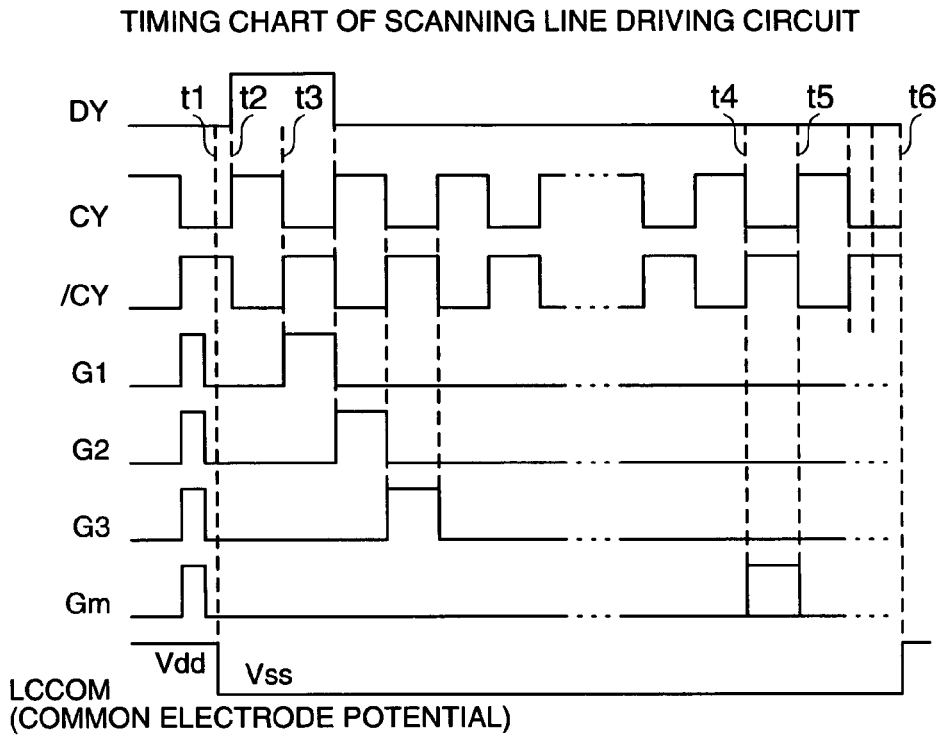
FIG. 5 is a timing chart showing the operation of a scanning line driving circuit.

As shown in FIG. 5, the driving circuit can be adapted to invert the common electrode potential LCCOM between a low voltage Vss, which is a ground potential, and a high voltage Vdd on a frame-to-frame basis to write the data signal of positive polarity (video signal) and the data signal of negative polarity alternately to each pixel 25. The term one frame used in this specification designates a period in which one screen page is displayed by selecting the scanning lines Y1-Ym in sequence and writing the data signal to the capacitors (liquid crystal capacitor 31 and accumulating capacitor 32) of every pixel 25.

As shown in FIG. 5, each scanning line driving circuit 33 is adapted to select the scanning lines Y1-Ym in sequence by generating and outputting scanning signals G1-Gm in sequence by a transfer start signal DY, a clock signal CY, and an inversion clock signal $\overline{CY}$ which are supplied at the beginning of the vertical scanning period in which the scanning lines Y1-Ym are selected in sequence. When the scanning lines Y1-Ym are selected in sequence and the scanning signals G1-Gm are supplied to each scanning line, all the TFTs 26 connected to the respective scanning lines are turned ON.

As shown in FIG. 5, when the common electrode potential LCCOM is inverted from the Vdd to the Vss at a timing of t1, and then the transfer start signal DY is supplied to the each scanning line driving circuit 33 at a timing of t2, the each scanning line driving circuit 33 selects the scanning lines Y1-Ym in sequence by generating and outputting the scanning signals G1-Gm in sequence from a timing of t3 to a timing of t4. After having terminated the selection period by the scanning signal Gm at a timing of t5, the common electrode potential LLCOM is inverted from the Vss to the Vdd at a timing of t6. This sequence is repeated.

Figure 6:
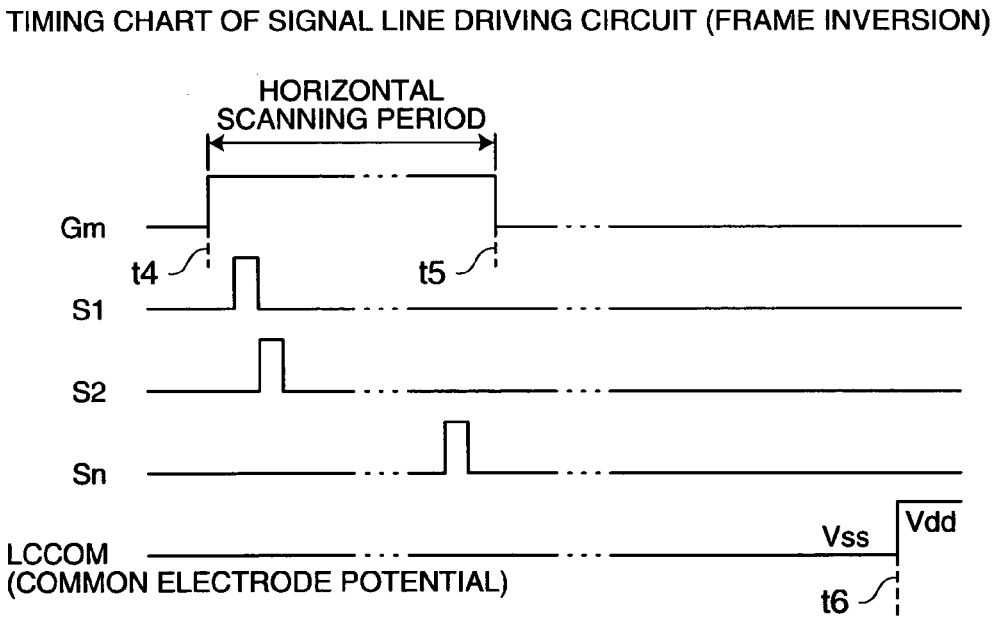
FIG. 6 is a timing chart showing the operation of a signal line driving circuit.

As shown in FIG. 6, the signal line driving circuit 34 is provided with a shift register (not shown) for outputting data signals S1-S2 at H level in sequence during one horizontal scanning period (from the timing of t4 to the timing of t5 in FIG. 6) during which the scanning lines Y1-Ym are selected in sequence.

Subsequently, referring to FIG. 1 and FIG. 7, the operation of the liquid crystal display device according to the present embodiment will be described.

As shown in FIG. 1, in the first sub field SF1 of a certain one frame (plus field), the scanning lines Y1-Ym are selected in sequence by the scanning signals G1-Gm. Accordingly, the TFT 26 of the each pixel 25 connected to the selected scanning line out of the scanning lines Y1-Ym is turned into the ON-state. In this manner, in each horizontal scanning period in which one of the scanning lines is selected in sequence, the data signal 11 of positive polarity is written to the corresponding pixels 25 respectively as the data signals S1-Sn. In this manner, by writing the data signal 11 of positive polarity to every pixel 25, display on one screen page is constructed.

Subsequently, in the second sub field SF2 of the plus field, in the each horizontal scanning period in which the scanning lines Y1-Ym are selected in sequence by the scanning signals G1-Gm, the non-data signal 12 of the same polarity as the data signal 11 of the first sub field SF1 (positive polarity) and of the maximum voltage value (+Vmax) is written to every pixel 25. In this manner, in the period of the second sub field SF2 in which the non-data signal 12 is written to every pixel 25, since the display mode is a normally white mode, the display of every pixel 25 is black as shown in FIG. 7(*a*). In other words, the transmittance ratio of the liquid crystal 24 of every pixel 25 becomes substantially 0%, and the entire screen page becomes a black display.

After having obtained a black display on the entire screen page in this manner, in the subsequent frame shown in FIG. 1 (minus field), the data signal 13 of negative polarity (−Vp) is written in sequence to the each corresponding pixel 25 in the each horizontal scanning period in which the scanning lines Y1-Ym are selected in sequence in the first sub field SF1, in the same manner as the first sub field SF1 of the plus field. FIG. 7(*b*) shows a state in which the data signal 13 is written to the plurality of pixels 25 connected to the scanning line Y1. FIG. 7(*c*) shows a state in which the data signal 13 is written in the plurality of pixels 25 connected to the scanning line Y2. In this manner, the data signal 13 is written to every pixel 25, and when writing of the data signal 13 to the plurality of pixels 25 connected to the scanning line Ym of the lowermost row is finished, the display of one screen page is constructed.

Then, in the second sub field SF2 of the minus field, a non-data signal 14 having the same polarity as the data signal 13 of the first sub field SF1 (negative polarity) and of the maximum voltage value (−Vmax) is written to every pixel 25 in the each horizontal scanning period in which the scanning lines Y1-Ym are selected in sequence. In period of the second sub field SF2 in which the non-data signal 14 is written to every pixel 25 as well, a black display as shown in FIG. 7(*a*) is obtained.

By repeating such operation, one screen page which is displayed by writing the data signal 11 of positive polarity thereto, one screen page of a black display, one screen page which is display by writing the data signal 13 of negative polarity thereto, and one screen page of a black display are constructed in sequence on a sub field-to-sub field basis having a time length of ½ frame.

According to the first embodiment thus arranged, the following advantages are obtained.

In frame inversion driving of the present embodiment, the data signal 11 or 13 having the opposite polarity from the first sub field SF1 of the previous frame is written in the first sub field SF1 of each frame. Subsequently (in the second subfield SF2 of the same frame), the non-data signal 12 or 14 having the same polarity as the written data signal and of the maximum voltage is written to every pixel 25.

By performing frame inversion driving as described above, when proceeding from the first sub field SF1 to the second sub field SF2 in each frame, variation in potential applied to each signal line X1-Xn, being the differential between the data signals 11, 13 and the non-data signals 12, 14 having the same polarity, decreases. Therefore, in any one of the frames, variations in potential applied to each signal line X1-Xn when proceeding from the first sub field SF1 to the second sub field SF2 are smaller than the case of the aforementioned normal frame inversion driving in which the data signals having the opposite polarity are written every other frame. Therefore, the pixel electrode potential of each pixel 25 to which the data signal is written is affected by variations in potential applied to each signal line X1-Xn and hence varies by leakage through the off resistance of the TFT 26. However, the amount of leakage is smaller than the case of the aforementioned normal frame inversion driving.

In frame inversion driving of the embodiment, in the second sub field SF2 of each frame, the non-data signal 12 or 14 having the same polarity as the data signal 11 or 13 and of the maximum voltage value is written to every pixel 25. Accordingly, in the embodiment, since the display mode is the normally white mode, the entire screen page becomes a black display. After having obtained a black display at every pixel 25, in the first sub field SF1 of the subsequent frame, the data signal having the opposite polarity from the data signal in the first sub field SF1 of the previous frame is written to every pixel 25.

When proceeding from the second sub field SF2 of the previous frame in which a black display is obtained to the first sub field SF1 of the subsequent frame as well in this manner, the pixel electrode potential of the each pixel 25 in which the voltage of a black display is retained varies due to the aforementioned leakage by being affected by variations in potential applied to the each signal line X1-Xn. However, as is clear from the V-T characteristic (Voltage-Transmittance ratio characteristic) of the liquid crystal shown in FIG. 2, a black display is in the stable area of the V-T curve, and hence variations in transmittance ratio is small even when the voltage varies to some extent. Therefore, even when the pixel electrode potential of the each pixel 25 varies by being affected by variations in potential applied to each signal line X1-Xn when proceeding from the second sub field SF2 of the previous frame to the first sub field SF1 of the subsequent frame, variations in transmittance ratio, that is, unevenness in luminance, of the liquid crystal 24 at each pixel 25, which is in a black display, is small.

Since such frame inversion driving is performed, cross-talk due to variations in pixel electrode potential of each pixel 25 caused by being affected by variations in potential applied to each signal line X1-Xn, that is, unevenness of luminance in the vertical direction on the liquid crystal display panel 21 may be controlled.

The display device of continuously illuminated type as in Japanese Unexamined Patent Application Publication No. 8-334741 described above (hold type display device) is inferior in the quality of the motion picture (visibility of the motion picture) in principle to the display device of the pulse illumination type such as a CRT (impulse type display device). In other words, with the hold type display device, a blurring phenomenon may occur when the motion picture is displayed. Such blurring phenomena occurs because when human sight follows the movement of the moving substance, even though the image previously displayed in the identical previous frame is continuously displayed during the period of time when the image is switched from the image of the previous frame to the image of the subsequent frame, human sight observes the image of the previous frame while moving thereon.

Figure 7:
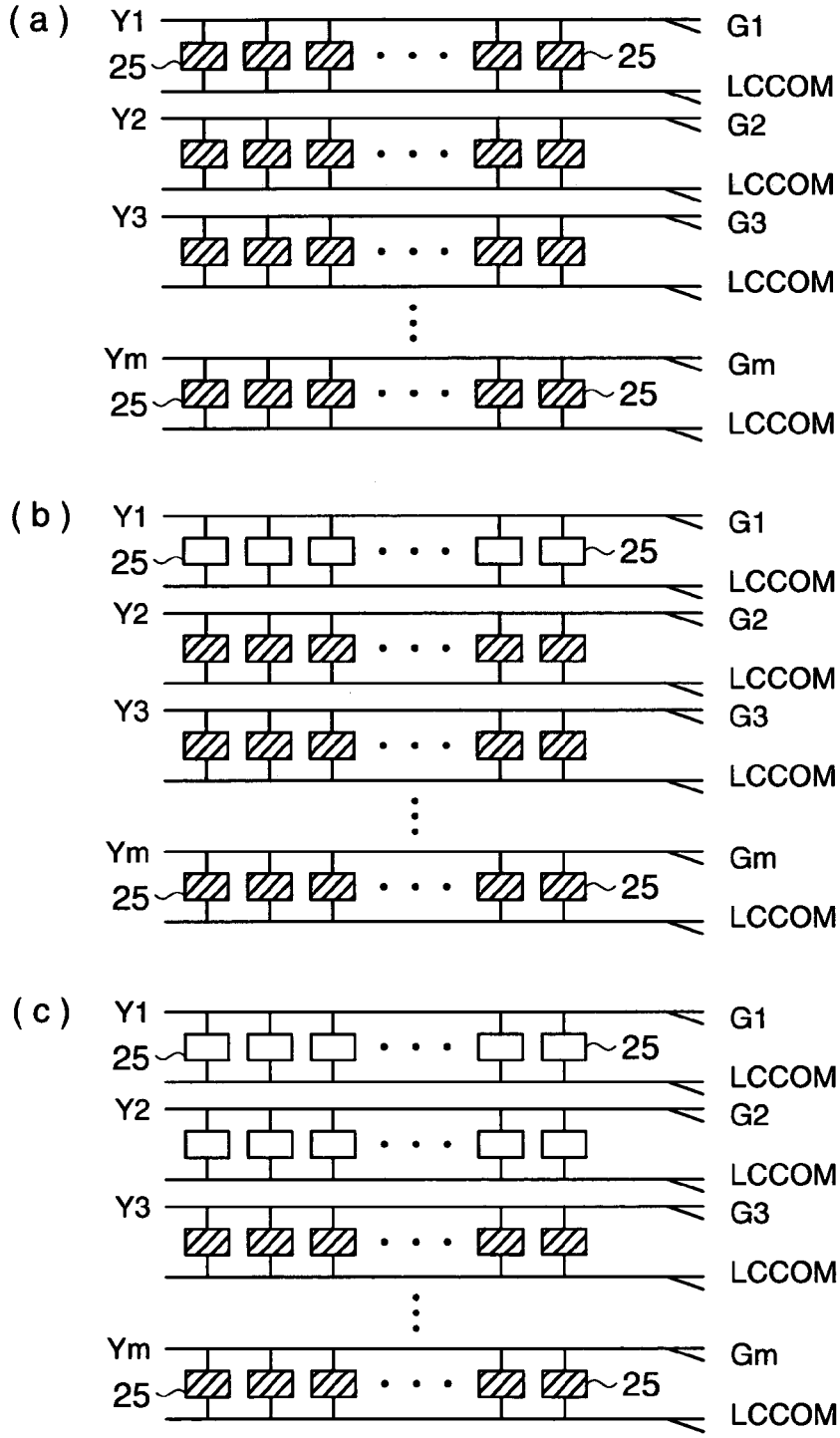
FIGS. 7 (*a*), (*b*), and (*c*) are explanatory drawings showing an impulse type display.

In contrast, in frame inversion driving of the present embodiment, by writing the non-data signal 12 or 14 in the second sub field SF2 of each frame, a black display is obtained at every pixel 25 as shown in FIG. 7(*a*). Accordingly, a period of black display is generated before the first sub field SF1 of each frame to which the data signal is written, and hence the impulse type display (non-hold type display) is obtained, whereby the quality of the motion picture increases.

The each frame is divided into two sub fields SF1, SF2, and the data signal having the opposite polarity from the previous frame is written in the first sub field SF1 of each frame, and the non-data signal is written in the second sub field SF2 of each frame. Accordingly, the data signal of positive polarity or negative polarity is written in the first sub field SF1 of each frame to obtain the display of one screen page, and the non-data signal is written in the second sub field SF2 of the same frame to obtain a black display. Accordingly, a display with less flickering is obtained.

When the time lengths of the two sub fields SF1, SF2 are equalized, and the frame frequency is set to 60 Hz, the cycle in which the data signal is written in the first sub field SF1 of each frame is 1/120 second. Therefore, writing of the data signal in the first sub field SF1 may be performed at a double speed.

Figure 8:
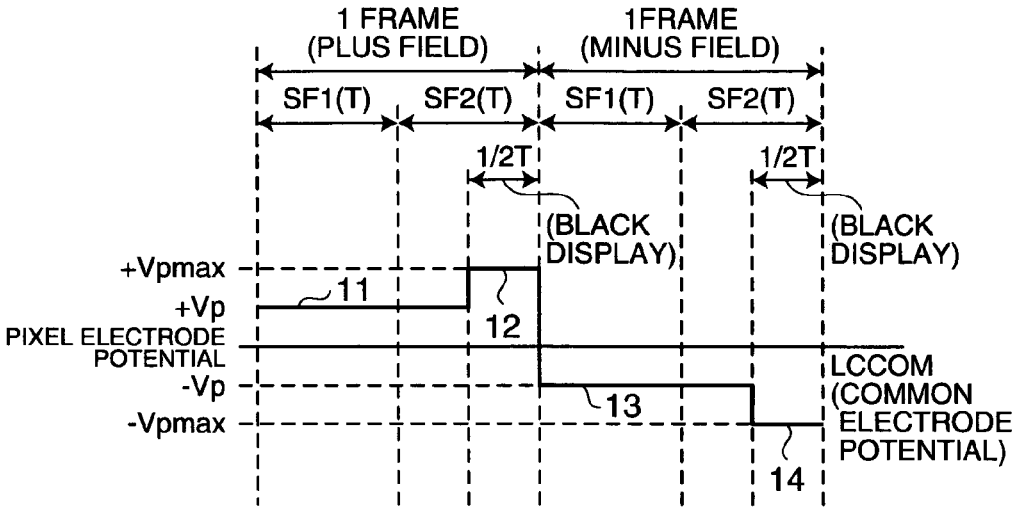
FIG. 8 is a wave form chart showing a driving method for the liquid crystal display device according to a second embodiment.

FIG. 8 shows a driving method for a liquid crystal display device according to a second embodiment of the present invention. Frame inversion driving for a liquid crystal display device of this embodiment differs from frame inversion driving of the first embodiment only in that the non-data signal 12 or 14 is written to every pixel 25 to obtain a black display in the latter half period (1/2T) of the second sub field SF2 of each frame. In other words, the period of time for writing and retaining the non-data signal 12 or 14 in the second sub field SF2 is set to half the period of time for writing and retaining the data signal 11 or 13 in the first sub field SF1.

Therefore, according to the embodiment, the voltage of the aforementioned non-data signals 12, 14, which is required for a black display is kept applied to the each signal line X1-Xn from the end of the first sub field SF1 of each frame until half 1/2T of the period T of the second sub field SF2 is elapsed. Then, at the moment when the period 1/2T is elapsed from the end of the first sub field SF1, the TFT 26 of each pixel 25 connected to a selected scanning line out of the scanning lines Y1-Ym selected in sequence as described above is brought into the ON-state.

According to the second embodiment thus arranged, the following advantage is obtained in addition to the aforementioned advantages (a) to (d).

A sufficient period of time can be secured for writing and retaining the data signal, and hence brighter display is achieved.

Figure 9:
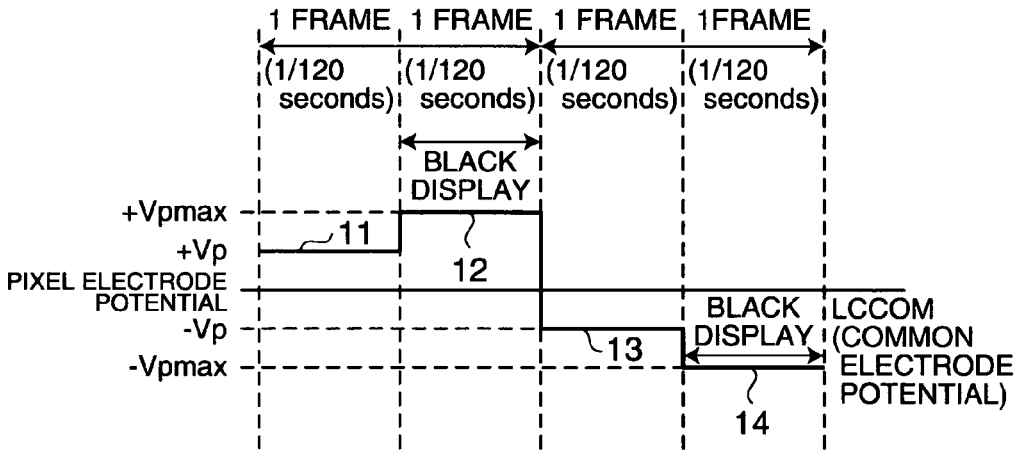
FIG. 9 is a wave form chart showing a driving method for the liquid crystal display device according to a third embodiment.

FIG. 9 shows a driving method for a liquid crystal display device according to a third embodiment of the invention. Frame inversion driving for the liquid crystal display device of this embodiment differs only in that one frame for writing the aforementioned non-data signals 12, 14 is provided respectively between two frames to which the aforementioned data signals 11, 13 having opposite polarities are written respectively. In other words, the period time for writing each data in the sequence of the aforementioned data signal 11, the non-data signal 12, the data signal 13, and the non-data signal 14 is configured to be one frame having the same time length.

According to the third embodiment thus arranged, the following advantages are obtained in addition to the aforementioned advantages.

Control of timings for writing the data signals 11, 13 and the non-data signals 12, 14 is facilitated, and a sufficient period of time can be secured for writing the data signals.

When the cycle of two frames is set to 1/60 second, the cycle of each frame for writing the data signal is 1/120 second, and hence writing of the data signals may be performed at a double speed.

Figure 10:
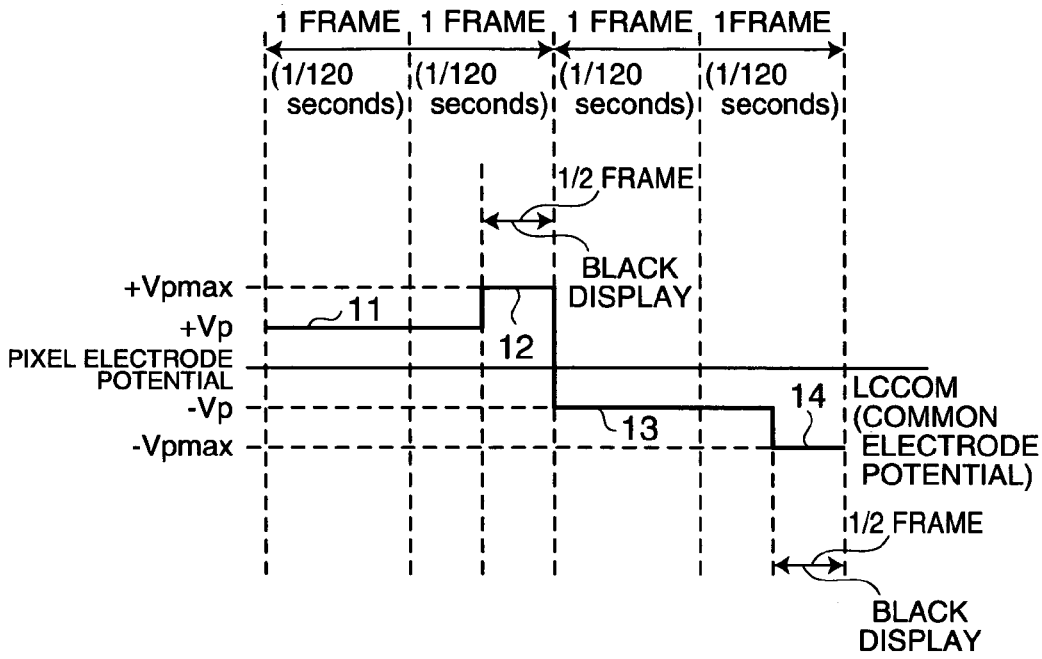
FIG. 10 is a wave form chart showing a driving method of the liquid crystal display device according to a fourth embodiment.

FIG. 10 shows a driving method for a liquid crystal display device according to a fourth embodiment of the present invention. Frame inversion driving for the liquid crystal display device of this embodiment differs from the aforementioned frame inversion driving according to the third embodiment in that the aforementioned non-data signals 12, 14 are written to every pixel 25 to obtain a black display in the latter half period (½ frame period) of one frame in each frame to which the non-data signals 12, 14 are written. In other words, the period of time for writing and retaining the non data signals 12, 14 is set to half the period of time for writing and retaining the data signals 11, 13. The driving method therefor is the same as the case of the second embodiment described above and shown in FIG. 8.

According to the fourth embodiment thus arranged, the aforementioned advantage that a sufficient period of time can be secured for writing and retaining the data signal, and hence brighter display is achieved can be obtained.

Figure 11:
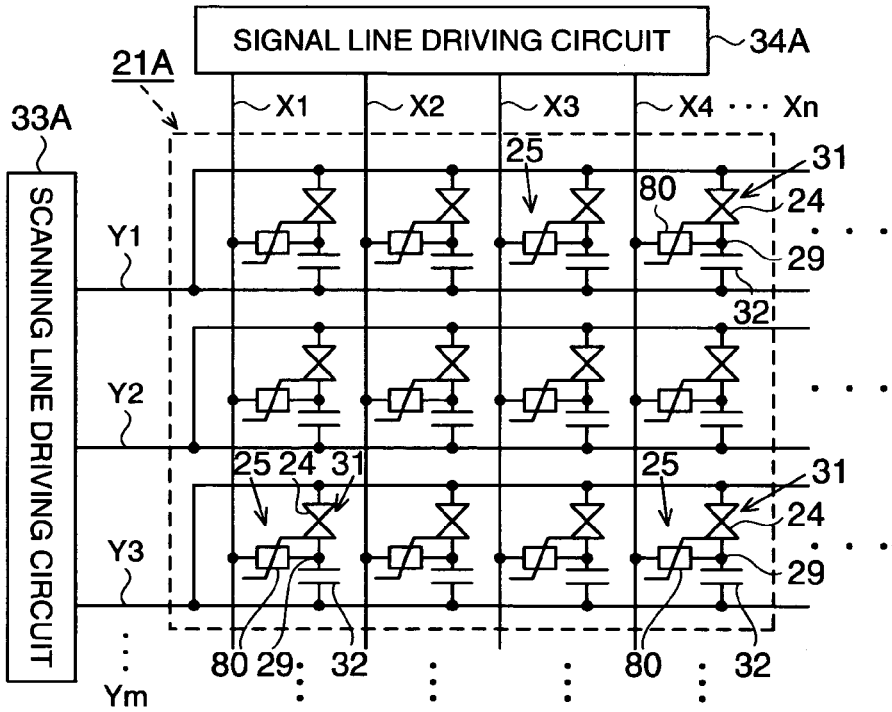
FIG. 11 is a schematic block diagram showing the electrical structure of the liquid crystal display device according to the fifth embodiment.
Figure 12:
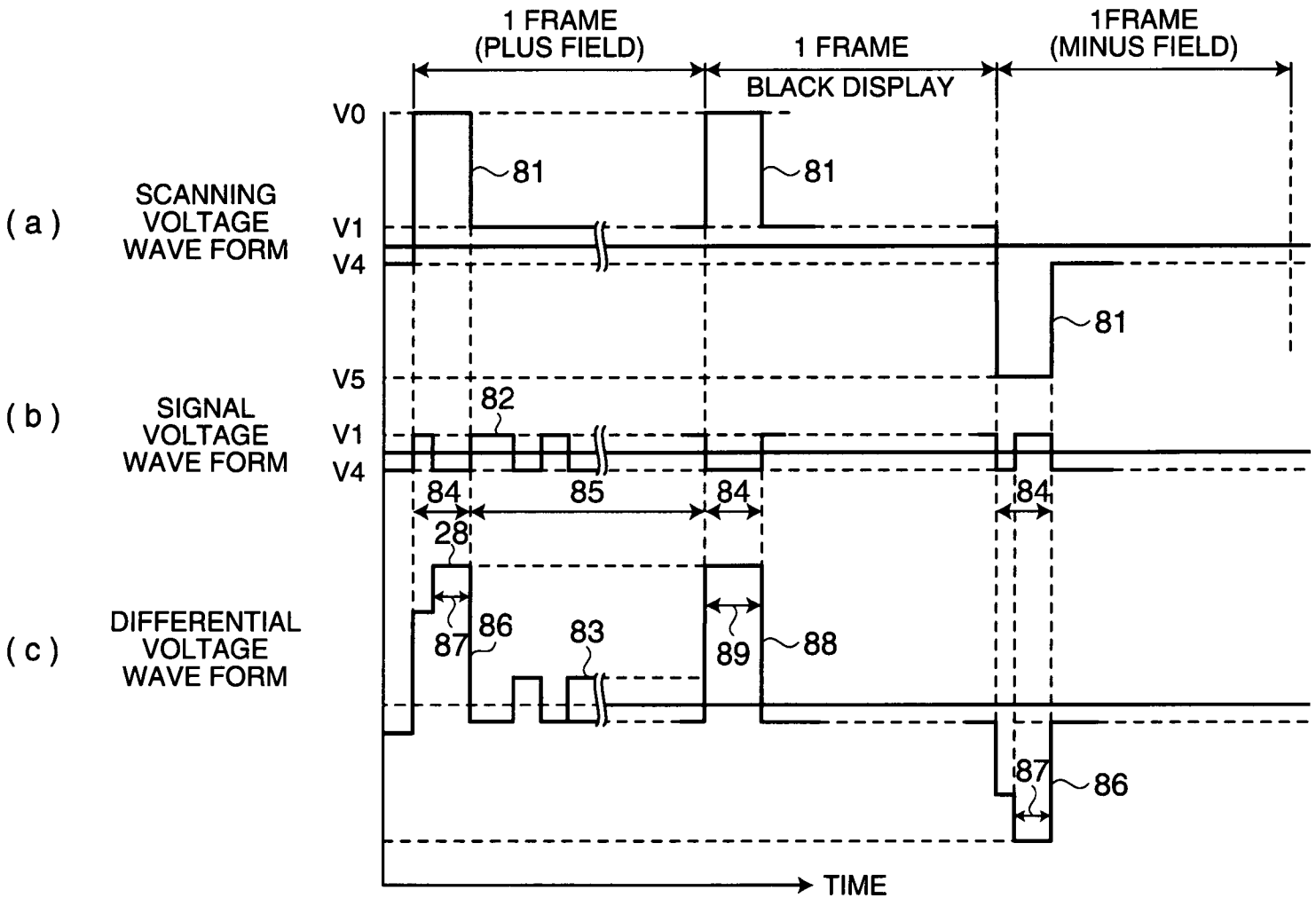
FIGS. 12 (*a*), (*b*), and (*c*) are wave form charts showing a driving method for the liquid crystal display device according to the fifth embodiment.

Referring to FIG. 11 and FIG. 12, a liquid crystal display device according to a fifth embodiment of the invention will be described. FIG. 11 schematically shows the electrical structure of the driving circuit of the liquid crystal display device and part of an electrically equivalent circuit of the liquid crystal display panel, and FIG. 12 shows the operation of frame inversion driving.

The liquid crystal display device is a two-terminal type active matrix liquid crystal display device employing an MIM element, which is a two-terminal switching element, at the each pixel 25. The liquid crystal display device has a liquid crystal display panel 21A as shown in FIG. 11. The liquid crystal display panel 21A can include the plurality of signal lines X1-Xn formed on one of the pair of substrates holding a liquid crystal layer, for example, on the element substrate, and the plurality of scanning lines Y1-Ym formed on the other, for example, the opposed substrate so as to intersect with the signal lines X-Xn, respectively. An MIM element 80 and the pixel electrode 29 are connected in series to each pixel 25 corresponding to the intersections between the scanning lines Y1-Ym and the signal lines X1-Xn. The MIM element 80 of each pixel is connected between the pixel electrode 29 and one of the scanning lines Y1-Ym.

At each pixel 25, the liquid crystal capacitor 31 including the liquid crystal layer as a dielectric material being constructed by the pixel electrode 29, the liquid crystal 24, and the scanning line or the signal line opposing the pixel electrode 29 via the liquid crystal 24. The display mode of the liquid crystal display panel 21A is also the normally white mode in which the display becomes darker as the absolute value of the voltage applied to each pixel electrode 29 (pixel voltage) increases.

In this liquid crystal display device, a signal line driving circuit 34A supplies a signal voltage wave form 82 (See FIG. 12(*b*)) as a data voltage signal for driving the plurality of signal lines X1-Xn to each signal line X1-Xn. A scanning line driving circuit 33A supplies a scanning voltage wave form 81 (see FIG. 12(*a*)) as a scanning voltage signal for driving the plurality of scanning lines Y1-Ym to each scanning line Y1-Ym. A power circuit, not shown, can be adapted to generate a plurality of voltages V0, V1, V4, V5 required for configuring the scanning voltage wave form 81 and the signal voltage wave form 82. More specifically, the power circuit generates the plurality of voltages V0, V1, V4, V5, and supplies V0 as a positive selecting voltage, V5 as a negative selecting voltage, V1 as a positive non-selecting voltage, and V4 as a negative non-selecting voltage to the scanning line driving circuit 33A. The power circuit supplies the voltage V1 and the voltage V4 to the signal line driving circuit 34A as a data voltage.

Then, in this liquid crystal display device, the plurality of scanning lines Y1-Ym are selected in sequence by (one selection period), and a period during which all the scanning lines Y1-Ym are selected once through is one frame. To a specific scanning line, which is selected in a certain selection period, is applied with the positive selecting voltage V0. When selection is finished, and hence the non-selection period is effected, the positive non-selecting voltage V1 is applied to the scanning line, and this state is maintained until next selection period. In the selection period after one frame period, the negative selecting voltage V5, which has the opposite polarity from the selecting voltage V0 applied previously, is applied. Then, when selection is finished and the non-selection period is effected, the negative non-selecting voltage V4 is applied, and this state is maintained until next selection period. This procedure is repeated for all the scanning lines Y1-Ym in sequence.

In the liquid crystal display device thus arranged, a driving method called pulse duration modulating system is employed for achieving gray scale display. In this driving method, as shown in FIG. 12(*b*), in each selection period, the signal line driving circuit 34A supplies a pulse signal taking a form of the signal voltage wave form 82 and having the positive data voltage V1 and the negative data voltage V4 to each signal line, and the duration of each pulse signal is adjusted according to the gray scale of each pixel to be displayed. In other words, in the case of the normally white mode, when the selecting voltage in a certain selection period is positive (in the case of the positive selecting voltage V0), the pixels become darker as the duration of application of the negative data voltage V4 increases, and becomes brighter as the duration of application of the negative data voltage V4 decreases. On the other hand, when the selecting voltage in the certain selection period is negative (in the case of the negative selecting voltage V5), the pixels become darker as the duration of application of the positive data voltage V1 increases, and becomes brighter as the duration of application of the data voltage V1 decreases. A voltage having the same polarity as the selecting voltage out of the positive and the negative binary voltages constituting this pulse signal is defined as an off voltage, and a voltage of the opposite polarity is defined as a on voltage.

A differential voltage wave form 83 to be applied to each pixel 25 will now be described. By applying the scanning voltage wave form 81 and the signal voltage wave form 82 during each selection period, the differential voltage wave form 83 as shown in FIG. 12(*c*) is applied to each pixel electrode 29 as the data signal. That is, the differential voltage wave form 83 includes a one selection period 84 and a non-selection period 85, and a signal is written to each pixel electrode 29 by a composite selecting pulse 86 in the one selection period 84. The signal written to each pixel electrode 29 in the non-selection period 85 is retained and stored. For gray scale display, a pulse duration 87 at the distal end portion of the composite selecting pulse 86 varies in accordance with the gray scale.

The MIM element 80 of each pixel 25 is turned on when the composite selecting pulse 86 (data signal) having a pulse duration according to the gray scale exceeds a threshold in the differential voltage wave form 83 between the scanning voltage wave form 81 (scanning voltage) supplied via the scanning line in each selection period and the signal voltage wave form 82 (signal voltage) supplied via the signal line.

Then, as shown in FIG. 12, in frame inversion driving of the embodiment, the composite selecting pulse 86 (data signal) of positive polarity is written in each selection period of each frame, for example, of the plus field. Thereafter, in the subsequent frame, a non-data signal 88 having the same polarity as the written composite selecting pulse 86 and of a maximum pulse duration 89 is written to every pixel 25. After having written the non-data signal 88, in the subsequent frame (minus field), the composite selecting pulse 86 having the opposite polarity from the composite selecting pulse 86 written in the previous frame (plus field) is written to the pixels 25. This operation is repeated subsequently.

According to the fifth embodiment thus arranged, the following advantages may be obtained.

After having written the composite selecting pulse 86 (data signal) of positive polarity or of negative polarity in each frame, the non-data signal 88 having the same polarity as the written composite selecting pulse 86 and of the maximum pulse duration 89 is written to every pixel 25. The non-data signal 88 is a voltage signal having the same polarity as the composite selecting pulse 86 written in the previous frame and of the maximum pulse duration 89. Therefore, there is no variation in potential applied to each signal line when the non-data signal 88 is written to every pixel after having written the composite signal pulse 86 in each frame. Consequently, the pixel electrode potential of each pixel 25 to which the composite selecting pulse 86 is written does not vary due to leakage via the off resistance of the MIM element 80.

Also, after having written the non-data signal 88 and a black display is obtained at every pixel, the composite selecting pulse 86 having the opposite polarity from the composite selecting pulse 86 of the previous frame is written to the pixels 25. In this manner, when the composite selecting pulse 86 having the opposite polarity from the composite selecting pulse 86 written in the previous frame is written to the each pixel 25 after having obtained a black display, the pixel electrode potential of each pixel at which the voltage of a black display is retained varies due to the aforementioned leakage caused by being affected by variations in potential applied to each signal line. However, a black display is in the stable area of the V-T curve, and thus the amount of variation in transmittance ratio is small even when the voltage varies to some extent. Therefore, the pixel electrode potential at each pixel varies by being affected by variations in potential applied to the each signal line when a composite selecting pulse 86 having the opposite polarity from the composite selecting pulse 86 written in the previous frame is written to every pixel after having obtained a black display, variations in transmittance ratio of the liquid crystal at each pixel, that is, unevenness in luminance is small.

Since the aforementioned frame inversion driving is performed, cross-talk, that is, unevenness in luminance in the vertical direction caused by variations in the pixel electrode potential of the each pixel by being affected by variations in potential applied to the each signal line can be controlled. In addition, since a black display is obtained at every pixel by writing the non-data signal 88, the period of a black display is generated between one frame and the subsequent frame in which the composite selecting pulses 86 are written, respectively. Accordingly, a display of an impulse type (display of non-hold type) is obtained, and hence the advantages in that the quality of the motion picture is improved may be obtained at the same time.

Figure 13:
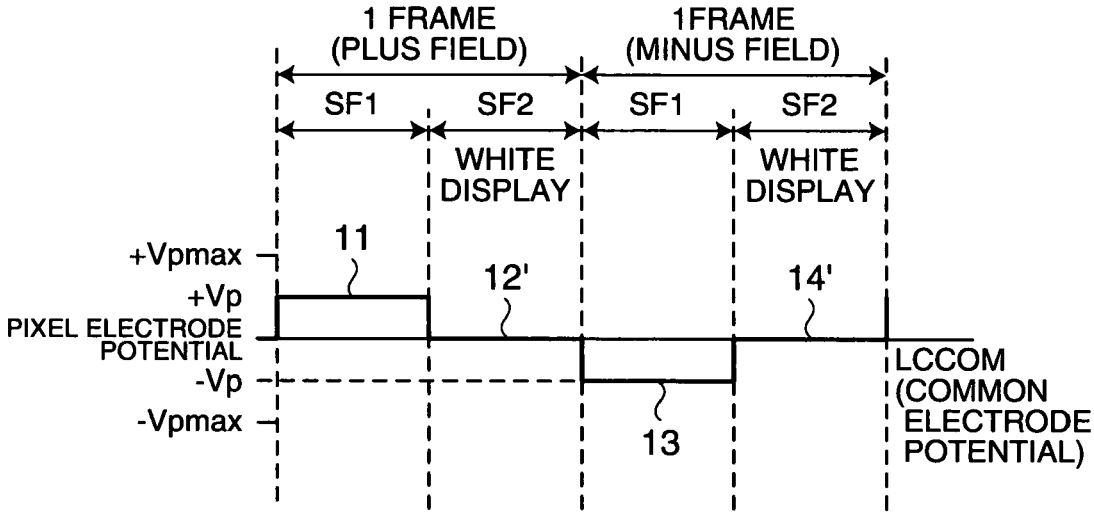
FIG. 13 is a wave form chart showing a driving method for the liquid crystal display device according to a sixth embodiment.

FIG. 13 shows a driving method for a liquid crystal display device according to a sixth embodiment of the invention. In this liquid crystal display device, the display mode of the liquid crystal display panel 21 is the normally white mode, and a white display can be obtained. Therefore, in frame inversion driving of this liquid crystal display device, a non-data signal 12' or 14' having the same polarity as the data signal 11 or 13 written in the sub field SF1 and of a minimum voltage value are applied in the each sub field SF2 in the same frame.

According to the sixth embodiment thus arranged, the following advantage can be obtained.

A white display obtained in the second sub field SF2 of each frame is in the stable area of the V-T curve of the liquid crystal as in the case of a black display in the aforementioned first embodiment, and thus the amount of variation in transmittance ratio is small even when the voltage varies to some extent. Therefore, even when the pixel electrode potential at each pixel 25 varies by being affected by variations in potential applied to the each signal line X1-Xn when proceeding from the second sub field SF2 to the first sub field SF1 of the subsequent frame, variations in transmittance ratio of the liquid crystal 24 at each pixel 25 in a white display, that is, unevenness in luminance is small. Therefore, as in the case of the aforementioned advantage (a), cross-talk, that is, unevenness in luminance in the vertical direction on the liquid crystal display panel 21 caused by variations in the pixel electrode potential of the each pixel 25 by being affected by variations in potential applied to the each signal line X1-Xn can be controlled.

Subsequently, electronic equipment using the liquid crystal display panel 21 of the liquid crystal display device described in the aforementioned embodiment will be described. The liquid crystal display panel 21 shown in FIG. 3 and the liquid crystal display panel 21A shown in FIG. 11 can be applied to a mobile personal computer shown in FIG. 14. The personal computer 90 shown in FIG. 14 includes a body portion 92 having a keyboard 91, and a display unit 93 employing the liquid crystal display panel 21 or 21A. In this personal computer 90, low power consumption and bright display are achieved with high level of fineness.

The invention may be embodied by making modification as follows.

In the first to the fourth embodiments, the invention may be applied for configuring to obtain a white display by setting the display mode to the normally black mode and writing the non-data signals 12, 14 having the same polarity as the data signal written in the sub field SF1 and of the maximum voltage to the every pixel.

In the fifth embodiment, it is also possible to set the display mode to the normally black mode and write the non-data signal 88 having the same polarity as the composite selecting pulse 86 as the data signal written in the previous frame and of the maximum pulse duration 89 in the frame between the plus field and the minus field. In this configuration, a white display can be obtained and the aforementioned advantage that the amount of variation in transmittance ratio is small can achieved as in the case of the sixth embodiment shown in FIG. 13.

The aforementioned fifth embodiment may be configured so as to write the non-data signal having the same polarity as the composite selecting pulse 86 as the data signal written in the previous frame and of the minimum pulse duration in the frame between the plus field and the minus field while keeping the normal white mode. In this configuration, a white display can be obtained and the aforementioned advantage that the amount of variation in transmittance ratio is small can achieved as in the case of the sixth embodiment shown in FIG. 13.

In the aforementioned sixth embodiment shown in FIG. 13, a white display may be obtained instead of a black display in the aforementioned first embodiment shown in FIG. 1. However, in the aforementioned second to the fourth embodiments, a white display may be obtained instead of a black display by applying the non-data signal having the same polarity as the data signal and of a minimum voltage. It should be understood that the invention may also be applied to such configuration.

In the aforementioned first embodiment, the common electrode potential LCCOM is inverted on a frame-to-frame basis for performing inversion driving for the liquid crystal. However, the invention may also be applied in the case where inversion driving of the liquid crystal is effected by other methods.

Although the liquid crystal 24 of the TN (Twisted Nematic) type is used in the aforementioned embodiment, it should be understood that the invention is not limited thereto. The liquid crystal must simply be one in which frame inversion to write the data signal of positive polarity and the data signal of negative polarity to the each pixel via the switching element alternately on a frame-to-frame basis can be performed. For example, variety of types of known liquid crystal, such as a STN (Super Twisted Nematic) type having twisted orientation more than 180°, a BTN (Bi-stable Twisted Nematic) type, a polymer dispersion type, and a guest host type, and so on may be widely used.

In the aforementioned fifth embodiment, the MIM element is used as a switching element of the each pixel. However, the present invention may be applied to the configuration in which non-linear resistive element such as a back-to-back diode element, a diode-ring element, a varistor element, and the like is employed instead.

Figure 14:
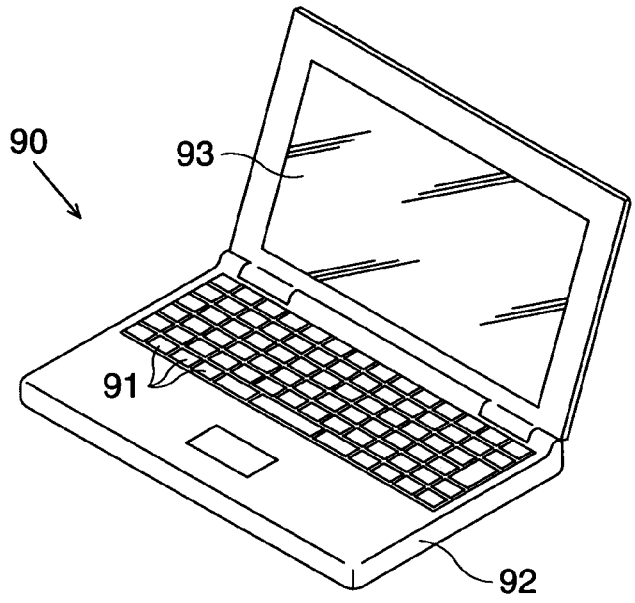
FIG. 14 is a perspective view showing electronic equipment employing the liquid crystal display panel.
Figure 15:
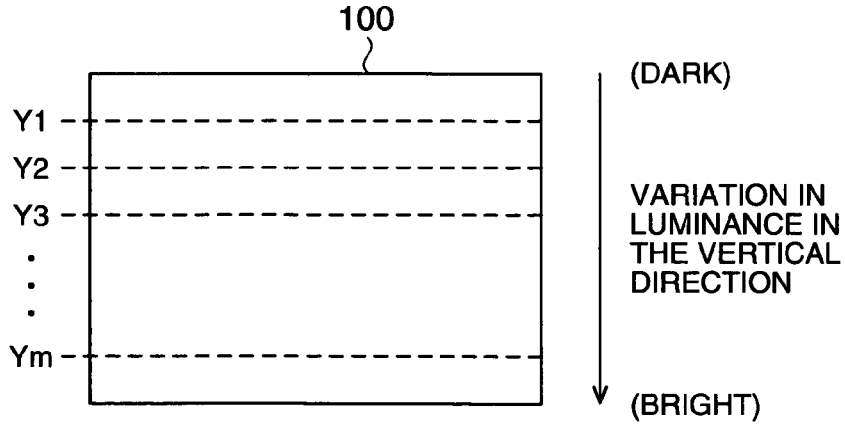
FIG. 15 is an explanatory drawing showing a problem in the related art.

The liquid crystal display panels 21, 21A of the liquid crystal display device may be applied not only to the personal computer shown in FIG. 14, but also to various types of electronic equipment such as a mobile phone, a digital camera, and the like.

Although the electro-optical apparatus is described as the liquid crystal display device in the aforementioned embodiment, the present invention is not limited thereto, and it may be applied also to an electro-optical apparatus employing an AC drive electro-optical element as the liquid crystal and electronic equipment provided with the electro-optical apparatus.

What is claimed is:

1. A driving method for an electro-optical apparatus, including switching elements disposed, respectively, at a plurality of pixels arranged in a matrix manner corresponding to intersections of a plurality of scanning lines and a plurality of signal lines, and the electro-optical apparatus being adapted to write a data signal of positive polarity and a data signal of negative polarity to each pixel via the switching elements alternately on a frame-to-frame basis, the driving method comprising:

selecting, during a first sub field of each frame, a scanning line of the plurality of scanning lines and applying the data signal to a pixel corresponding to the scanning line; and applying, during a first portion of a second sub field that follows the first sub field, a non-data signal that has a same polarity as the data signal applied to the pixel and of a maximum voltage value to a signal line corresponding to the pixel and selecting, during a second portion that follows the first portion of the second sub field, a scanning line and applying the non-data signal to the pixel.

2. The driving method for an electro-optical apparatus according to claim 1, the electro-optical element being liquid crystal, and a three-terminal switching element which is turned on when a scanning signal being supplied during each selection period that selects the plurality of scanning lines in sequence is employed as the switching element, and the data signal and the non-data signal supplied from the plurality of signal lines are written to the pixels in line sequence via the three-terminal switching element in the ON-state.

3. The driving method for an electro-optical apparatus according to claim 1 the period of time for writing and retaining the non-data signal in the second sub field being shorter than the period of time for writing and retaining the data signal in the first sub field.

4. An electro-optical apparatus, comprising:

switching elements disposed, respectively, at a plurality of pixels arranged in a matrix manner corresponding to the intersections of a plurality of scanning lines and a plurality of signal lines;

the electro-optical apparatus being adapted to write a data signal of positive polarity and a data signal of negative polarity to each pixel via the switching elements alternately on a frame-to-frame basis, and further comprising:

a three-terminal switching element as the switching element, which is turned on when a scanning signal is supplied during each selection period for selecting the plurality of scanning lines in sequence;

a scanning line driving circuit and a signal line driving circuit that drive the plurality of scanning line and the plurality of signal line, respectively; and a control circuit that controls the scanning line driving circuit and the signal line driving circuit, selects, during a first sub field of each frame, a scanning line of the plurality of scanning lines and applies the data signal to a pixel corresponding to the scanning line, and applies, during a first portion of a second sub field that follows the first sub field, a non-data signal that has a same polarity as the data signal applied to the pixel and of a maximum voltage value to a signal line corresponding to the pixel and selects, during a second portion that follows the first portion of the second sub field, a scanning line and applies the non-data signal to the pixel.

5. The electro-optical apparatus according to claim 4, the period of time for writing and retaining the non-data signal in the second sub field being shorter than the period of time for writing and retaining the data signal in the first sub field.

6. Electronic equipment, comprising the electro-optical apparatus according to claim 4.

* * * * *